US010655613B2

(12) United States Patent
Zhang

(10) Patent No.: US 10,655,613 B2
(45) Date of Patent: May 19, 2020

(54) HIGH-PRESSURE PUMP CONTROL UNIT

(71) Applicant: DENSO CORPORATION, Kariya, Aichi-pref. (JP)

(72) Inventor: Chi Zhang, Kariya (JP)

(73) Assignee: DENSO CORPORATION, Kariya (JP)

( * ) Notice: Subject to any disclaimer, the term of this patent is extended or adjusted under 35 U.S.C. 154(b) by 387 days.

(21) Appl. No.: 15/296,173

(22) Filed: Oct. 18, 2016

(65) Prior Publication Data

US 2017/0211558 A1 Jul. 27, 2017

(30) Foreign Application Priority Data

Jan. 21, 2016 (JP) ..... 2016-9706

(51) Int. Cl.

| | |
|---|---|
| ***F04B 7/00*** | (2006.01) |
| ***F04B 53/10*** | (2006.01) |
| ***F02D 41/20*** | (2006.01) |
| ***F04B 53/00*** | (2006.01) |
| ***F04B 49/06*** | (2006.01) |

(Continued)

(52) U.S. Cl.

CPC ..... *F04B 7/0076* (2013.01); *F02D 41/20* (2013.01); *F02D 41/3082* (2013.01); *F02M 59/025* (2013.01); *F02M 59/102* (2013.01); *F04B 1/0408* (2013.01); *F04B 1/0426* (2013.01); *F04B 1/0456* (2013.01); *F04B 1/053* (2013.01); *F04B 9/042* (2013.01); *F04B 17/05* (2013.01); *F04B 23/04* (2013.01); *F04B 49/06* (2013.01); *F04B 49/065* (2013.01); *F04B 53/001* (2013.01); *F04B 53/10* (2013.01); *F04B 53/102* (2013.01); *F04B 53/14* (2013.01); *F02D 41/3845* (2013.01); *F02D 2041/2037* (2013.01); *F02D 2041/2058* (2013.01); *F02M 59/368* (2013.01)

(58) Field of Classification Search

None

See application file for complete search history.

(56) References Cited

U.S. PATENT DOCUMENTS 5,959,825 A * 9/1999 Harcombe ..... F02D 41/20 361/152
7,552,720 B2 * 6/2009 Borg ..... F02M 59/366 123/506

(Continued)

FOREIGN PATENT DOCUMENTS

JP 2015-021428 A 2/2015
JP 2015-045322 A 3/2015

*Primary Examiner* — Peter J Bertheaud
*Assistant Examiner* — Geoffrey S Lee
(74) *Attorney, Agent, or Firm* — Posz Law Group, PLC

(57) ABSTRACT

When a condition for reducing a noise caused in the high-pressure pump is satisfied, a reduction control unit implements a noise reduction control to supply a smaller power to reduce a moving speed of a movable portion in a close acting direction to put a valve body into a closed state for a predetermined time after an energization start timing of a solenoid in a plunger rising period. A closing control unit causes a closing current, which is a constant current for surely putting the valve body into the closed state, to flow the closing current in the solenoid when the noise reduction control is completed in the plunger rising period. The predetermined time is shorter than an energization period in which a current flows in the solenoid.

13 Claims, 8 Drawing Sheets

(51) Int. Cl.

| | |
|---|---|
| ***F02D 41/30*** | (2006.01) |
| ***F02M 59/02*** | (2006.01) |
| ***F02M 59/10*** | (2006.01) |
| ***F02M 59/36*** | (2006.01) |
| ***F02D 41/38*** | (2006.01) |
| ***F04B 23/04*** | (2006.01) |
| ***F04B 1/053*** | (2020.01) |
| ***F04B 9/04*** | (2006.01) |
| ***F04B 17/05*** | (2006.01) |
| ***F04B 53/14*** | (2006.01) |
| ***F04B 1/0456*** | (2020.01) |
| ***F04B 1/0408*** | (2020.01) |
| ***F04B 1/0426*** | (2020.01) |
| *F04B 1/04* | (2020.01) |

(56) References Cited

U.S. PATENT DOCUMENTS

| | | | | |
|---|---|---|---|---|
| 9,726,104 | B2 * | 8/2017 | Tokuo | F02D 41/20 |
| 2009/0301441 | A1 | 12/2009 | Hasegawa et al. | |
| 2013/0032212 | A1 * | 2/2013 | Tokuo | F02D 41/20 137/1 |
| 2014/0099215 | A1 * | 4/2014 | Kawano | F02M 59/368 417/279 |
| 2014/0158205 | A1 * | 6/2014 | Tanabe | F02D 41/3845 137/1 |
| 2017/0082099 | A1 * | 3/2017 | Takagawa | F02D 41/2464 |
| 2017/0089291 | A1 * | 3/2017 | Suzuki | F02D 41/3082 |

* cited by examiner

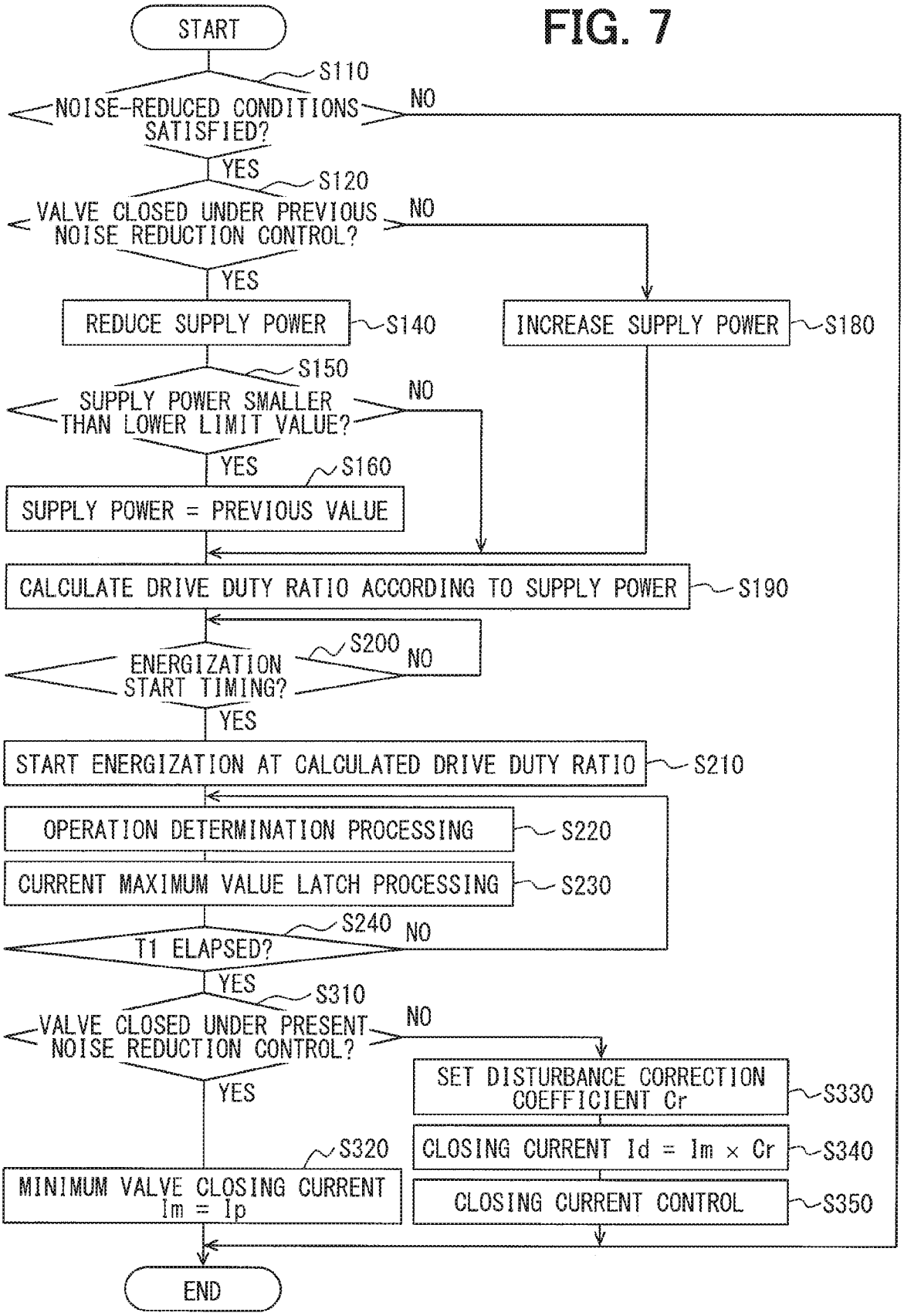
FIG. 7
START
S110
NOISE-REDUCED CONDITIONS SATISFIED?
NO
YES
S120
VALVE CLOSED UNDER PREVIOUS NOISE REDUCTION CONTROL?
NO
YES
REDUCE SUPPLY POWER
S140
INCREASE SUPPLY POWER
S180
S150
SUPPLY POWER SMALLER THAN LOWER LIMIT VALUE?
NO
YES
S160
SUPPLY POWER = PREVIOUS VALUE
CALCULATE DRIVE DUTY RATIO ACCORDING TO SUPPLY POWER
S190
S200
ENERGIZATION START TIMING?
NO
YES
START ENERGIZATION AT CALCULATED DRIVE DUTY RATIO
S210
OPERATION DETERMINATION PROCESSING
S220
CURRENT MAXIMUM VALUE LATCH PROCESSING
S230
S240
T1 ELAPSED?
NO
YES
S310
VALVE CLOSED UNDER PRESENT NOISE REDUCTION CONTROL?
NO
YES
SET DISTURBANCE CORRECTION COEFFICIENT Cr
S330
CLOSING CURRENT Id = Im × Cr
S340
S320
MINIMUM VALVE CLOSING CURRENT Im = Ip
CLOSING CURRENT CONTROL
S350
END

HIGH-PRESSURE PUMP CONTROL UNIT

CROSS REFERENCE TO RELATED APPLICATION

This application is based on Japanese Patent Application No. 2016-9706 filed on Jan. 21, 2016, the disclosure of which is incorporated herein by reference.

TECHNICAL FIELD

The present disclosure relates to a high-pressure pump control unit.

BACKGROUND

A known system supplies a fuel to an in-cylinder injection engine of a vehicle. In such a system, low pressure fuel is pumped by an electric pump from a fuel tank and the fuel is supplied to a high-pressure pump that is driven by a power of the engine. In addition, high pressure fuel that is discharged from the high-pressure pump is pumped into a fuel reservoir. The high pressure fuel is supplied from the fuel reservoir to respective multiple injectors.

For example, Patent Document 1 discloses a high-pressure pump including components such as a solenoid, a movable portion, and a stopper.

(Patent Document 1)

Publication of Unexamined Japanese Patent Application No. 2015-45322

In such a high-pressure pump of Patent Document 1, when the solenoid is energized to cause the movable portion vigorously to collide with the stopper, a loud noise occurs.

SUMMARY

It is an object of the present disclosure to produce a high-pressure pump control unit configured to reduce an operating noise of a high-pressure pump and to produce a reliable operation of the high-pressure pump.

For example, as disclosed in Patent Document 1, the high-pressure pump includes a pressurizing chamber having an inlet port and a discharge port of the fuel. The high-pressure pump of Patent Document 1 further includes the plunger that moves back and forth in the pressurizing chamber. The pressurizing chamber is also called "pump chamber." Further, the high-pressure pump includes a valve body that opens and closes a fuel passage that is led to the inlet port. The high-pressure pump further includes a first spring that urges the valve body in a direction of causing the valve body to close the fuel passage (hereinafter referred to as "closing direction"). The high-pressure pump further includes an electromagnetic actuator that causes the opening and closing movement of the valve body. The electromagnetic actuator includes a movable portion that is urged by a second spring to push the valve body in an opening direction opposite to the closing direction. The electromagnetic actuator further includes the solenoid that is energized to attract the movable portion in a direction (hereinafter referred to as "close acting direction") opposite to the direction of causing the movable portion to push the valve body. In Patent Document 1, the movable portion is also called "valve body", and the solenoid is referred to as "coil".

In the high-pressure pump of this type, in a plunger rising period in which a plunger rises from a bottom dead center to a top dead center, the valve body is put into the closed state with the energization of the solenoid, and fuel in the pressurizing chamber is discharged from the discharge port into the fuel reservoir.

On the other hand, in the high-pressure pump, when the solenoid is energized to cause the movable portion vigorously to collide with the stopper located at an end position in the close acting direction, a loud noise arises. The noise causes an operating noise of the high-pressure pump, and an occupant in the vehicle may feel the operating noise to be unpleasant noise.

For that reason, in the control unit, when the engine is put into an idle operating state and when a condition for reducing the operating noise of the high-pressure pump has been satisfied, a control for reducing the operating noise of the high-pressure pump is performed as follows.

In the control, a duty ratio of a voltage to be applied to the solenoid is set to be smaller than 100% of a normal time to decrease a moving speed of the movable portion since the energization of the solenoid starts until a current (hereinafter referred to as "solenoid current") flowing in the solenoid reaches a predetermined target value. In the control unit, after the solenoid current has reached the target value, the duty ratio of the voltage to be applied to the solenoid is controlled so that the solenoid current is maintained at the target value.

In the control unit, the control for reducing the operating noise of the high-pressure pump, that is, the control for setting the duty ratio of the voltage to be supplied to the solenoid to be less than the duty ratio in the normal time is continued until the solenoid current reaches the target value. For that reason, an energization period of the solenoid is completed before the solenoid current reaches the target value, resulting in a possibility that the valve body cannot be put into the closed state. In the high-pressure pump, unless the valve body is put into the closed state in the plunger rising period, because the fuel is not discharged from the discharge port, the normal operation is not achieved.

According to an aspect of the present disclosure, a high-pressure pump control unit is configured to control a high-pressure pump. The high-pressure pump includes a pressurizing chamber having an intake port and a discharge port of fuel. The high-pressure pump further includes a plunger configured to move back and forth in the pressurizing chamber. The high-pressure pump further includes a valve body configured to open and close a fuel passage that is led to the intake port. The high-pressure pump further includes a first spring configured to urge the valve body in a closing direction to put the valve body into a closed state in which the valve body closes the fuel passage. The high-pressure pump further includes an electromagnetic actuator configured to cause an opening and closing movement of the valve body. The electromagnetic actuator includes a movable portion, which is urged by a second spring to bias the valve body in an opening direction opposite to the closing direction, and a solenoid, which is energized to draw the movable portion in a close acting direction, which is opposite to the direction in which the movable portion pushes the valve body, to put the valve body into the closed state. In a plunger rising period, in which the plunger rises from a bottom dead center to a top dead center, the solenoid is configured to be energized to put the valve body into the closed state and to discharge fuel in the pressurizing chamber from the discharge port. The high-pressure pump control unit comprises a reduction control unit configured, when a condition for reducing a noise caused in the high-pressure pump is satisfied, to implement a noise reduction control to supply a power smaller than a power, which is supplied when the condition is not satisfied, to reduce a moving speed of the movable portion in the close acting direction for a predetermined time after an energization start timing of the solenoid in the plunger rising period. The high-pressure pump control unit further comprises a closing control unit configured, when the condition is satisfied, to cause a closing current, which is a constant current for surely putting the valve body into the closed state, to flow the closing current in the solenoid when the noise reduction control is completed in the plunger rising period. The predetermined time is shorter than an energization period in which a current flows in the solenoid.

BRIEF DESCRIPTION OF THE DRAWINGS

The above and other objects, features and advantages of the present invention will become more apparent from the following detailed description made with reference to the accompanying drawings. In the drawings:

FIG. 7 is a flowchart illustrating control processing according to a second embodiment.

DETAILED DESCRIPTION

Hereinafter, modes for carrying out the present disclosure will be described with reference to the accompanying drawings.

First Embodiment (Overall Configuration)

Figure 1:
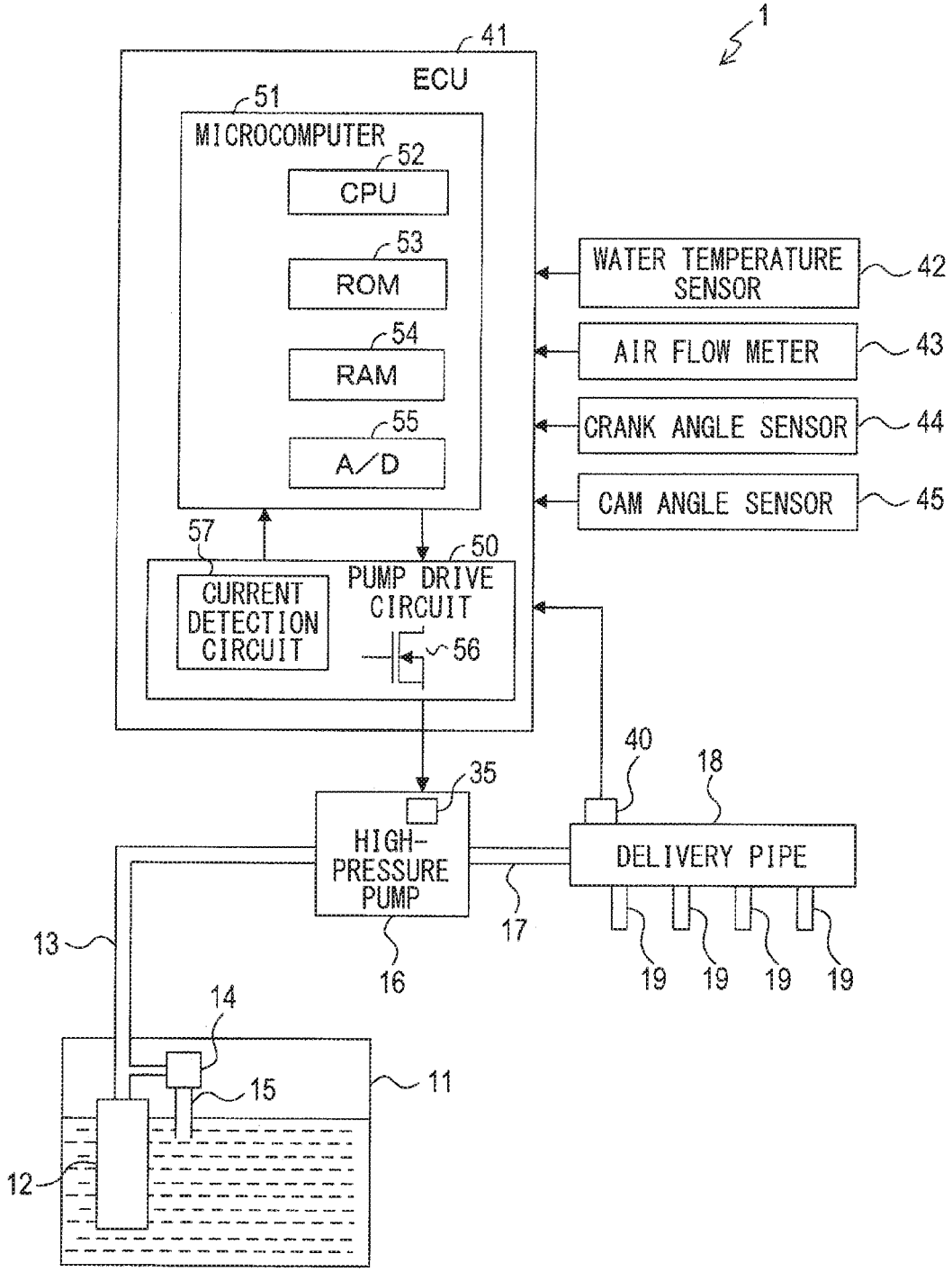
FIG. 1 is a block diagram illustrating an overall configuration of a fuel supply system according to a first embodiment.

As shown in FIG. 1, a fuel supply system 1 according to a first embodiment is configured to supply fuel to an engine of an automobile.

The fuel supply system 1 includes a fuel tank 11 that reserves the fuel, a low-pressure pump 12, a low-pressure fuel pipe 13, a pressure regulator 14, a fuel return pipe 15, a high-pressure pump 16, a high-pressure fuel pipe 17, a delivery pipe 18, and multiple injectors 19. The injectors 19 are equipped to respective cylinders of the engine. Four injectors 19 are provided to the engine of the present example.

The low-pressure pump 12 is driven by an electric motor having a battery (hereinafter referred to as "vehicle battery") of the automobile as a power supply, and pumps the fuel in the fuel tank 11. The fuel pumped from the low-pressure pump 12 is supplied to the high-pressure pump 16 through the low-pressure fuel pipe 13.

The low-pressure fuel pipe 13 is coupled with the pressure regulator 14. A pressure of the fuel to be supplied from the low-pressure pump 12 to the high-pressure pump 16 is regulated to a predetermined constant pressure by the pressure regulator 14. The fuel having a pressure exceeding the constant pressure in the fuel discharged from the low-pressure pump 12 is returned into the fuel tank 11 through the fuel return pipe 15.

The high-pressure pump 16 compresses and discharges the fuel flow at a low pressure supplied through the low-pressure fuel pipe 13. The fuel at a high pressure discharged from the high-pressure pump 16 is sent through the high-pressure fuel pipe 17 and reserved in the delivery pipe 18. The fuel in the delivery pipe 18 is distributed to the injectors 19 for the respective cylinders. The fuel high in the pressure is injected from the injectors 19 into the respective cylinders.

Figure 2:
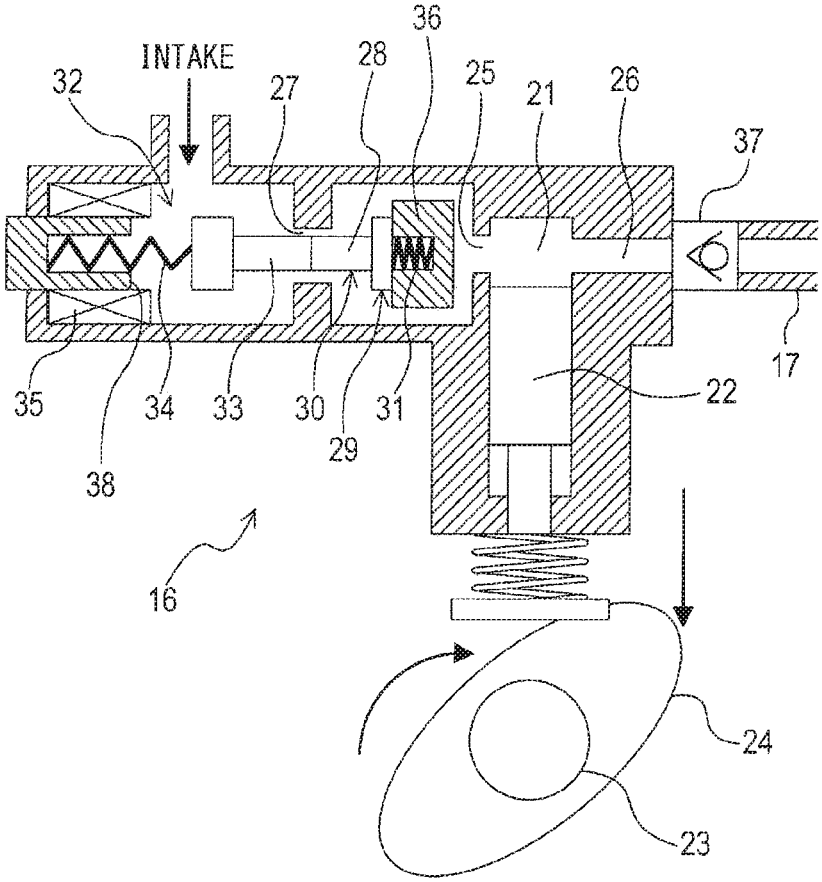
FIG. 2 is a schematic configuration diagram illustrating a state in which a high-pressure pump draws fuel.
Figure 3:
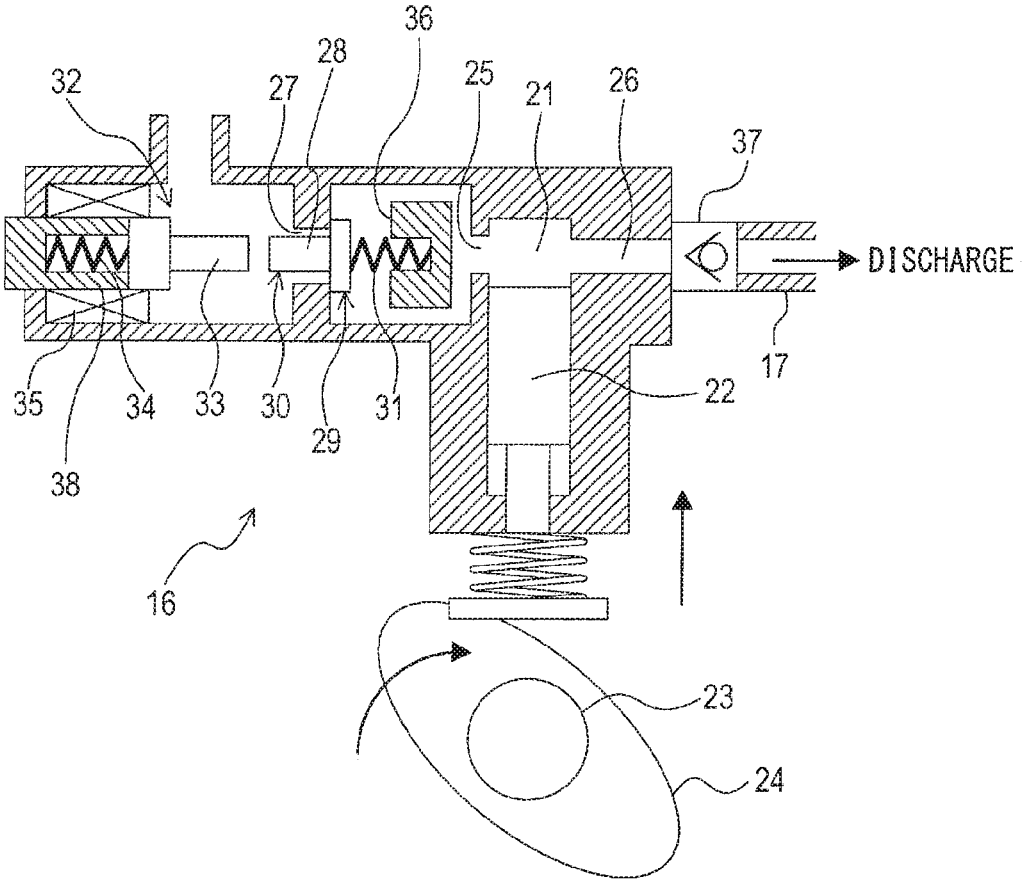
FIG. 3 is a schematic configuration diagram illustrating a state in which the high-pressure pump discharges the fuel.

As illustrated in FIGS. 2 and 3, the high-pressure pump 16 is configured by a plunger pump that includes a cylindrical pressurizing chamber 21 and a plunger 22, and draws and discharges the fuel while moving the plunger 22 back and forth in the pressurizing chamber 21.

The plunger 22 is driven by a rotational motion of a cam 24 fitted to a camshaft 23 of the engine. In this example, the camshaft 23 is configured to open and close an exhaust valve of the engine. It is noted that, the camshaft 23 may be configured to open and close an intake valve of the engine.

The pressurizing chamber 21 includes an intake port 25, which is for drawing the low pressure fuel into the pressurizing chamber 21, and a discharge port 26, which is for discharging the fuel in the pressurizing chamber 21 toward the external of the high-pressure pump 16. The intake port 25 is led to a fuel passage 27 in the high-pressure pump 16. The low pressure fuel supplied from the low-pressure pump 12 to the high-pressure pump 16 through the low-pressure fuel pipe 13 reaches the intake port 25 through the fuel passage 27, and is drawn into the pressurizing chamber 21 from the intake port 25.

The high-pressure pump 16 includes a valve body 28 that opens and closes the fuel passage 27 as a control valve, a spring 31 that urges the valve body 28 toward a direction of a closed position side, and an electromagnetic actuator 32 that causes opening and closing movement of the valve body 28.

The closed position of the valve body 28 is a position where the valve body 28 becomes in a closed state to close the fuel passage 27, and is presented by a position of the valve body 28 illustrated in FIG. 3. The operation in which the valve body 28 puts into the closed state is also called "valve closing". The direction of the closed position side as a moving direction of the valve body 28 is referred to as "closing direction", and a direction opposite to the closing direction is referred to as "opening direction". In FIGS. 2 and 3, a left direction represents the closing direction, and a right direction represents the opening direction.

The valve body 28 includes a valve portion 29 for opening and closing the fuel passage 27, and a pressing portion 30. The pressing portion 30 is configured to protrude from the valve portion 29 toward the electromagnetic actuator 32 side, and is pressed in the opening direction by a movable portion 33 of the electromagnetic actuator 32.

An end position of the valve body 28 moving in the opening direction is a position at which the valve portion 29 abuts against a stopper portion 36 located in the high-pressure pump 16 as shown in FIG. 2. The position is referred to as "fully opened position" of the valve body 28.

The electromagnetic actuator 32 includes the movable portion 33 that is movable, a spring 34 that urges the movable portion 33 in a direction toward the valve body 28 side, and a solenoid 35 that is energized to attract the movable portion 33 in a direction opposite to the direction of the valve body 28 side. A force of the spring 34 is larger than that of the spring 31. As a direction of moving the movable portion 33, a direction of the valve body 28 side, that is, a direction of pressing the valve body 28 due to an urging force of the spring 34 is referred to as "open acting direction", and a direction opposite to the open acting direction is referred to as "close acting direction". Referring to FIGS. 2 and 3, a left direction represents the close acting direction, and a right direction represents the open acting direction.

As illustrated in FIG. 2, when the solenoid 35 is not energized, the movable portion 33 moves in the open acting direction due to the force of the spring 34 and abuts against the pressing portion 30 to press the valve body 28 in the opening direction. When a fuel pressure (hereinafter referred to as "pressurizing chamber internal pressure") in the pressurizing chamber 21 is low, the valve body 28 moves in the opening direction from the closed position, and the fuel passage 27 is opened. The operation in which the valve body 28 puts into an opened state to open the fuel passage 27 is also called "valve opening".

For that reason, as illustrated in FIG. 2, in a period (hereinafter referred to as "plunger falling period") in which the plunger 22 falls from the top dead center, and a volume of the pressurizing chamber 21 increases, if the energization of the solenoid 35 stops, the valve body 28 is opened. When the valve body 28 is opened, a low pressure fuel is drawn into the pressurizing chamber 21 through the fuel passage 27 and the intake port 25. A period in which the fuel is drawn into the pressurizing chamber 21 represents an intake stroke.

As illustrated in FIG. 3, when the solenoid 35 is energized, the movable portion 33 moves in the close acting direction due to an electromagnetic attraction force of the solenoid 35, and moves away from the pressing portion 30. Then, the valve body 28 moves in the closing direction due to the force of the spring 31, and is held at the closed position. In other words, the valve body 28 is closed.

For that reason, in a period (hereinafter referred to as "plunger rising period") in which the plunger 22 rises from the bottom dead center, and the volume of the pressurizing chamber 21 is reduced, when the solenoid 35 is energized to close the valve body 28, the fuel in the pressurizing chamber 21 is discharged from the discharge port 26 while being compressed.

The discharge port 26 is led to the delivery pipe 18 through the high-pressure fuel pipe 17. The discharge port 26 side of the high-pressure pump 16 is equipped with a check valve 37 for preventing a backflow of the discharged fuel. The fuel discharged from the discharge port 26 represents a high pressure fuel discharged from the high-pressure pump 16. A period during which the fuel is discharged from the discharge port 26 represents a discharge stroke.

On the other hand, a period until the valve body 28 is closed in the plunger rising period represents a period in which the fuel in the pressurizing chamber 21 is returned from the low-pressure fuel pipe 13 side through the intake port 25 and the fuel passage 27. The period represents a metering stroke for regulating the fuel discharge amount.

The end position in the close acting direction in the moving range of the movable portion 33 represents a position at which the movable portion 33 abuts against a stopper portion 38 in which the spring 34 is housed as illustrated in FIG. 3. The position is referred to as "close side end position" of the movable portion 33. The end position in the open acting direction in the moving range of the movable portion 33 represents a position at which the movable portion 33 abuts against the pressing portion 30 of the valve body 28 located at a fully opened position, which is a position of the movable portion 33 illustrated in FIG. 2. The position is referred to as "open side end position" of the movable portion 33.

In the high-pressure pump 16, the energization start timing of the solenoid in the plunger rising period is controlled, thereby to control a valve closing period of the valve body 28 in the plunger rising period, and further control the fuel discharge amount. The fuel discharge amount from the high-pressure pump 16 is controlled, thereby to control the fuel pressure (hereinafter referred to as "pipe internal pressure") in the delivery pipe 18. For example, when the pipe internal pressure is raised, the energization start timing of the solenoid 35 in the plunger rising period is advanced, and the valve closing period of the valve body 28 in the plunger rising period is retarded, thereby to increase the fuel discharge amount. Conversely, when the pipe internal pressure is reduced, the energization start timing of the solenoid 35 in the plunger rising period is delayed, and the valve closing period of the valve body 28 in the plunger rising period is shortened, thereby to reduce the fuel discharge amount.

As illustrated in FIG. 1, the delivery pipe 18 is equipped with a pressure sensor 40 for detecting the pipe internal pressure. The fuel supply system 1 includes an ECU 41 that controls at least the high-pressure pump 16 and the injectors 19. The ECU is an abbreviation of an electronic control unit.

The ECU 41 receives a signal from the pressure sensor 40. Further, the ECU 41 receives, as signals for detecting the operating state of the engine, signals from various sensors such as a water temperature sensor 42, an airflow meter 43, a crank angle sensor 44, a cam angle sensor 45, and so on.

The pressure sensor 40 outputs a signal of the voltage corresponding to the pipe internal pressure. The water temperature sensor 42 outputs a signal of the voltage corresponding to a coolant temperature of the engine. The airflow meter 43 outputs a signal of the voltage corresponding to an intake air amount of the engine.

The output signal of the crank angle sensor 44 is a signal pulse generated at every predetermined crank angle according to the rotation of the crankshaft of the engine. When a crank angle position reaches a predetermined specific position, a specific waveform indicative of this fact is obtained. The specific waveform is longer in pulse generation intervals than the other waveforms. Meanwhile, the crank angle represents a rotation angle of the crank shaft, and the crank angle position represents a rotational position of the crankshaft.

The output signal of the cam angle sensor 45 represents, for example, a signal indicating that the rotational position of the camshaft 23 reaches a predetermined reference position. In the ECU 41, the crank angle position with two rotations of the crankshaft as one cycle and the rotational speed of the engine are detected on the basis of the output signal of the crank angle sensor 44 and the output signal of the cam angle sensor 45.

The ECU 41 includes a microcomputer 51 as a control unit for governing the operation of the ECU 41. Further, the ECU 41 includes a pump drive circuit 50 for energizing the solenoid 35 of the high-pressure pump 16 according to a drive signal from the microcomputer 51.

The pump drive circuit 50 includes a drive transistor 56 for switching between the energization and deenergization of the solenoid 35. For example, one end of the solenoid 35 is connected to a power supply line electrically connected to a positive terminal of the vehicle battery, and the other end of the solenoid 35 is connected to a ground line electrically connected to a negative terminal of the vehicle battery by turning on the drive transistor 56. For that reason, when the drive transistor 56 turns on, a voltage across the vehicle battery (hereinafter referred to as "battery voltage") is applied to the solenoid 35, and a current flows in the solenoid 35. This example shows a low-side drive mode in which the drive transistor 56 is located downstream of the solenoid 35. Alternatively, a high-side drive mode in which the drive transistor 56 is located upstream of the solenoid 35 may be employed.

The pump drive circuit 50 also includes a current detection circuit 57 for detecting a solenoid current. The solenoid current represents a current flowing in the solenoid 35. The current detection circuit 57 includes a current detection resistor located on an energization path of the solenoid 35, and outputs a signal of the voltage corresponding to the solenoid current to the microcomputer 51.

In addition, the ECU 41 includes an injector drive circuit for driving the respective injectors 19, and so on according to injection command signals from the microcomputer 51.

The microcomputer 51 includes a CPU 52, a ROM 53, a RAM 54, an ND converter 55, and so on. The microcomputer 51 detects the solenoid current on the basis of the signal from the current detection circuit 57. The microcomputer 51 detects the pipe internal pressure on the basis of the signal from the pressure sensor 40, and detects the operating state of the engine on the basis of the signal from the other various sensors. The microcomputer 51 controls the high-pressure pump 16 and the various injectors 19 on the basis of those detection results.

The various types of processing performed by the microcomputer 51 are produced by causing the CPU 52 to execute programs stored in a non-transitory tangible recording medium. In this example, the ROM 53 corresponds to the non-transitory tangible recording medium storing the programs. In addition, methods corresponding to the programs are executed by the execution of the programs. Meanwhile, the number of microcomputers configuring the control unit may be one or plural. Further, a technique for producing the control unit is not limited to software, but a part or all of the elements may be produced with the use of hardware combined with a logic circuit, an analog circuit, or the like.

(Control of High-Pressure Pump)

The microcomputer 51 calculates a target pipe internal pressure that is a target value of the pipe internal pressure on the basis of the operating state of the engine. Further, the microcomputer 51 calculates the energization start timing and the energization end timing of the solenoid 35 for producing the target pipe internal pressure. The energization start timing is calculated as a timing in the plunger rising period. The energization end timing also represents a timing during the plunger rising period, and is calculated as a timing before a timing (hereinafter referred to as "pump TDC timing") at which the position of the plunger 22 becomes the top dead center. A period from the energization start timing to the energization end timing during the plunger rising period represents an energization period in which a current flows in the solenoid 35 for the purpose of discharging the fuel. Meanwhile, the energization end timing may represent the same timing as the pump TDC timing.

Figure 4:
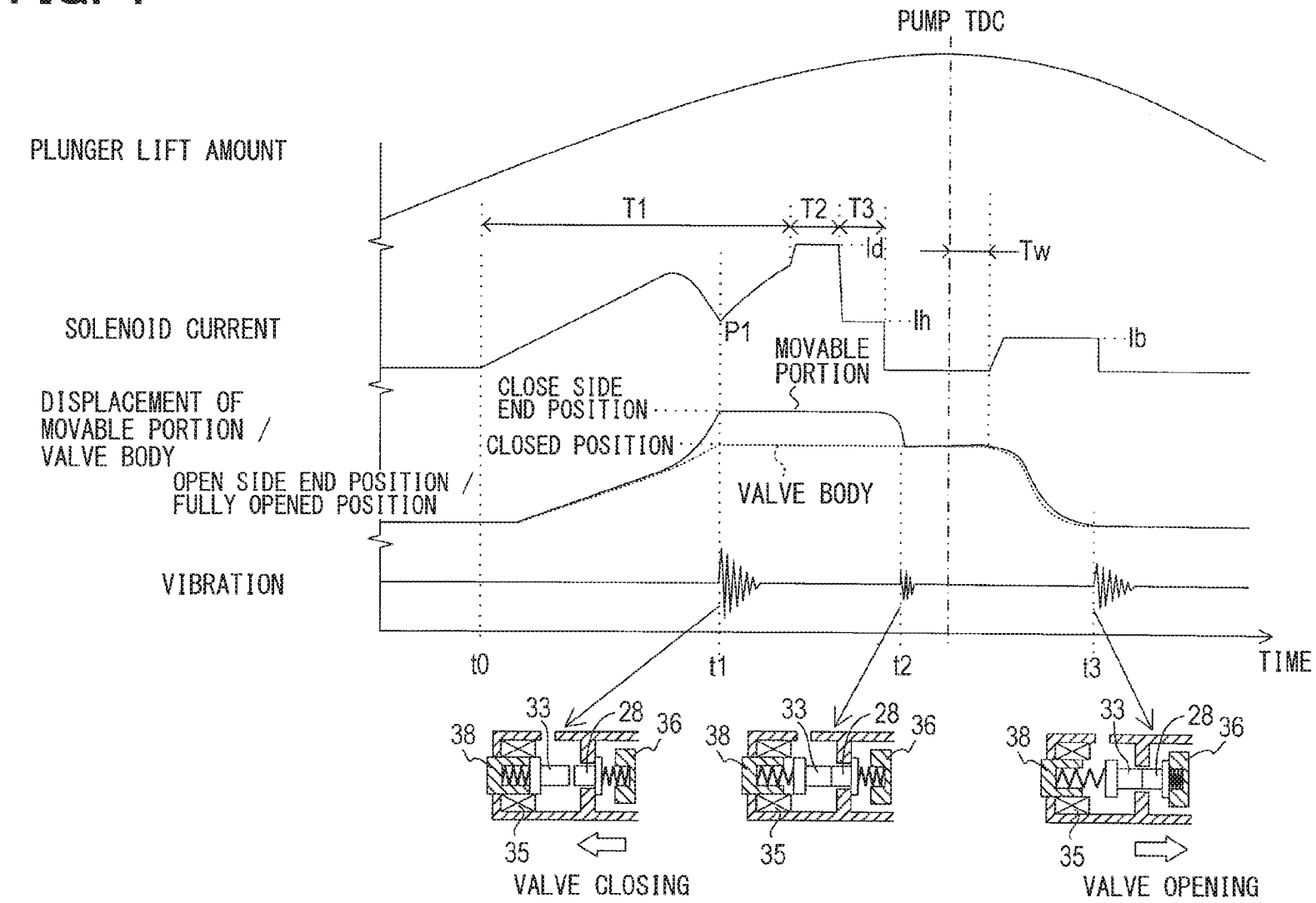
FIG. 4 is an illustrative view illustrating a control of the high-pressure pump according to the first embodiment.

As indicated at a time t0 in FIG. 4 when the calculated energization start timing comes, the microcomputer 51 starts to energize the solenoid 35. Referring to FIG. 4, a timing indicated by "pump TDC" represents a pump TDC timing. Also, referring to FIG. 4 and the other figured to be described later, "plunger lift amount" represents the lift amount from the bottom dead center of the plunger 22.

Before the solenoid 35 starts to be energized, the high-pressure pump 16 is in a state illustrated in FIG. 2. In other words, the valve body 28 is at a fully opened position and the movable portion 33 is at the open side end position.

As illustrated in FIG. 4, when the energization of the solenoid 35 starts, the movable portion 33 moves from the open side end position toward the close side end position, and in association with this movement, the valve body 28 moves from the fully opened position to the closed position. In other words, as illustrated in FIG. 3, the high-pressure pump 16 is put into a state in which the valve body 28 has been closed. Then, the fuel starts to be discharged from the high-pressure pump 16.

In addition, as indicated at a time t1 in FIG. 4, when the movable portion 33 arrives at the close side end position, the movable portion 33 abuts against the stopper portion 38 to cause vibration. The noise generated by the vibration results in the operating noise of the high-pressure pump 16.

A driver may easily hear the operating noise of the high-pressure pump 16 and hardly hear the operating noise of the high-pressure pump 16 depending on a travel state of the automobile. For that reason, the microcomputer 51 stores a condition satisfied in the case of the travel state in which the operating noise of the high-pressure pump 16 is easily heard by the driver as a noise-reduced condition. For example, the noise-reduced condition includes a condition in which the engine is in an idle operating state. Alternatively, for example, the noise-reduced condition may include a condition in which the automobile is traveling at a low speed equal to or less than a predetermined speed.

When the noise-reduced condition is not satisfied, even if the noise is generated in the high-pressure pump, it is conceivable that the noise is not heard or is hardly heard by the driver. For that reason, the microcomputer 51 performs the following processing in a normal mode when it is determined that the noise-reduced condition is not satisfied.

In the normal mode, when the energization start timing of the solenoid comes, the microcomputer 51 sets a drive duty ratio of the drive transistor 56 in the pump drive circuit 50% to 100%, and rapidly increases the solenoid current up to a target maximum current. The drive duty ratio represents the duty ratio of the drive signal for turning on the drive transistor 56. In other words, the drive transistor 56 remains on until the solenoid current reaches the target maximum current. The target maximum current enables the valve body 28 to surely put into the closed state. In other words, the target maximum current enables the movable portion 33 to surely move to the close side end position. When the solenoid current reaches the target maximum current, the microcomputer 51 implements a constant current control. Specifically, first, a first constant current control for regulating the drive duty ratio of the drive transistor 56 so that the solenoid current is maintained at the target maximum current is implemented only for a predetermined time. Thereafter, a second constant current control for regulating the drive duty ratio of the drive transistor 56 so that the solenoid current is held at a constant holding current Ih is implemented until the energization period of the solenoid 35 is completed. The holding current Ih represents a minimum current that can hold the movable portion 33 at the close side end position.

On the other hand, when it is determined that the noise-reduced condition is satisfied, the microcomputer 51 performs the following processing in a noise reduction mode for the purpose of reducing the operating noise of the high-pressure pump 16.

As illustrated in FIG. 4, the microcomputer 51 implements the noise reduction control in the noise reduction mode for a predetermined first time T1 after the energization start timing of the solenoid 35. The noise reduction control supplies the power smaller than that in the normal time to the solenoid 35, and delays the moving speed of the movable portion 33 in the close acting direction compared with that in the normal time. The normal time represents a case in which the noise-reduced condition is not satisfied, in other words, a case in which the control in the normal mode is performed. Specifically, in the noise reduction control, the microcomputer 51 sets the drive duty ratio of the drive transistor 56 to a predetermined value smaller than 100% to reduce the power to be supplied to the solenoid 35 compared with that in the normal time. In addition, the first time T1 is set to a time shorter than a minimum time of the energization period of the solenoid 35.

When the noise reduction control is completed with the first time T1, the microcomputer 51 implements the closing current control for causing a constant closing current Id to flow in the solenoid 35 only for a predetermined second time T2. The closing current Id enables the valve body 28 to surely put into the closed state as with the target maximum current in the normal mode. Meanwhile, the closing current Id may be set to a fixed value, but may be variably set in the present embodiment. The closing current control is a constant current control for regulating the drive duty ratio of the drive transistor 56 so that the solenoid current is held at the closing current Id. A sum of the first time T1 and the second time T2 is shorter than a minimum time of the energization period of the solenoid 35.

The microcomputer 51 implements a holding current control for causing a constant holding current Ih to flow in the solenoid 35 for a time (hereinafter referred to as "third time") T3 since the second time T2 elapses until the energization period of the solenoid 35 is completed. The holding current Ih is the same value as that of the holding current Ih in the normal mode. The holding current control represents a constant current control for regulating the drive duty ratio of the drive transistor 56 so that the solenoid current is held at the holding current Ih, which is the same as the second constant current control in the normal mode.

Before the pump TDC timing comes, the microcomputer 51 stops the energization of the solenoid 35 in both of the normal mode and the noise reduction mode. When the solenoid 35 stops to be energized, the movable portion 33 moves from the close side end position in the open acting direction due to the force of the spring 34, and abuts against the pressing portion 30 of the valve body 28. As a result, the movable portion 33 presses the valve body 28 in the opening direction. However, in the plunger rising period, the closed valve body 28 is pressed by the high pressure fuel in the pressurizing chamber 21 in the closing direction. The force of the fuel in the closing direction is larger than a force (that is, the force of the spring 34) of causing the movable portion 33 to press the valve body 28 in the opening direction.

For that reason, in the plunger rising period, even if the energization of the solenoid 35 stops after the valve body 28 has been closed, the valve body 28 is maintained in the closed state. Meanwhile, as indicated at a time t2 in FIG. 4, when the energization of the solenoid 35 slops, and the movable portion 33 abuts against the pressing portion 30 of the valve body 28 located at the closed position, the vibration is generated, and the noise generated by the vibration is negligibly small.

Thereafter, when the plunger 22 reaches the top dead center, the discharge of the fuel from the high-pressure pump 16 is completed. Then, when the plunger 22 falls from the top dead center, and the pressurizing chamber internal pressure is reduced, the valve body 28 begins to move from the closed position in the opening direction. In other words, the valve body 28 is opened.

In this case, if the solenoid 35 remains deenergized, the valve body 28 forcefully moves in the opening direction and abuts against the stopper portion 36 due to the force pressed by the movable portion 33 and a negative pressure of the pressurizing chamber 21 attributable to the downward movement of the plunger 22. As a result, the vibration is generated. Because the noise caused by the vibration is relatively large, when the noise-reduced condition is satisfied, the driver is likely to hear the noise.

Under the circumstance, if it is determined that the noise-reduced condition is not satisfied, the microcomputer 51 deenergizes the solenoid 35 till the next plunger rising period. If it is determined that the noise-reduced condition is satisfied, the microcomputer 51 performs the following re-energization processing as additional processing for the noise reduction.

As illustrated in FIG. 4, when a predetermined waiting time Tw has elapsed since the pump TDC timing, the microcomputer 51 re-energizes the solenoid 35 to reduce the moving speed of the movable portion 33 in the open acting direction. This is because if the moving speed of the movable portion 33 in the open acting direction is reduced, the moving speed of the valve body 28 in the opening direction is reduced, and the vibration and the noise generated when the valve body 28 abuts against the stopper portion 36 can be reduced. In more detail, when the predetermined waiting time Tw has elapsed since the pump TDC timing, the microcomputer 51 regulates the drive duty ratio of the drive transistor 56 so that the solenoid current is maintained at the constant current 1*b*. Then, the microcomputer 51 implements such a re-energization only for a predetermined time by which the valve body 28 conceivably reaches the fully opened position.

The waiting time Tw is an estimated time from the pump TDC timing to the timing at which the valve body 28 starts to open. Also, the current Ib flowing in the solenoid 35 with such a re-energization enables the moving speed of the movable portion 33 in the open acting direction to be delayed, and is smaller than a current value that enables the movable portion 33 to move in the close acting direction. For example, the current Ib of the re-energization is set to a value smaller than the holding current Ih.

A time t3 in FIG. 4 is a time at which the valve body 28 reaches the fully opened position, in other words, a time at which the valve body 28 abuts against the stopper portion 36. The vibration and the noise generated at the time t3 when the re-energization of the solenoid 35 is implemented becomes smaller than those when the re-energization is not performed.

(Detail of Processing Performed by Microcomputer)

Figure 5:
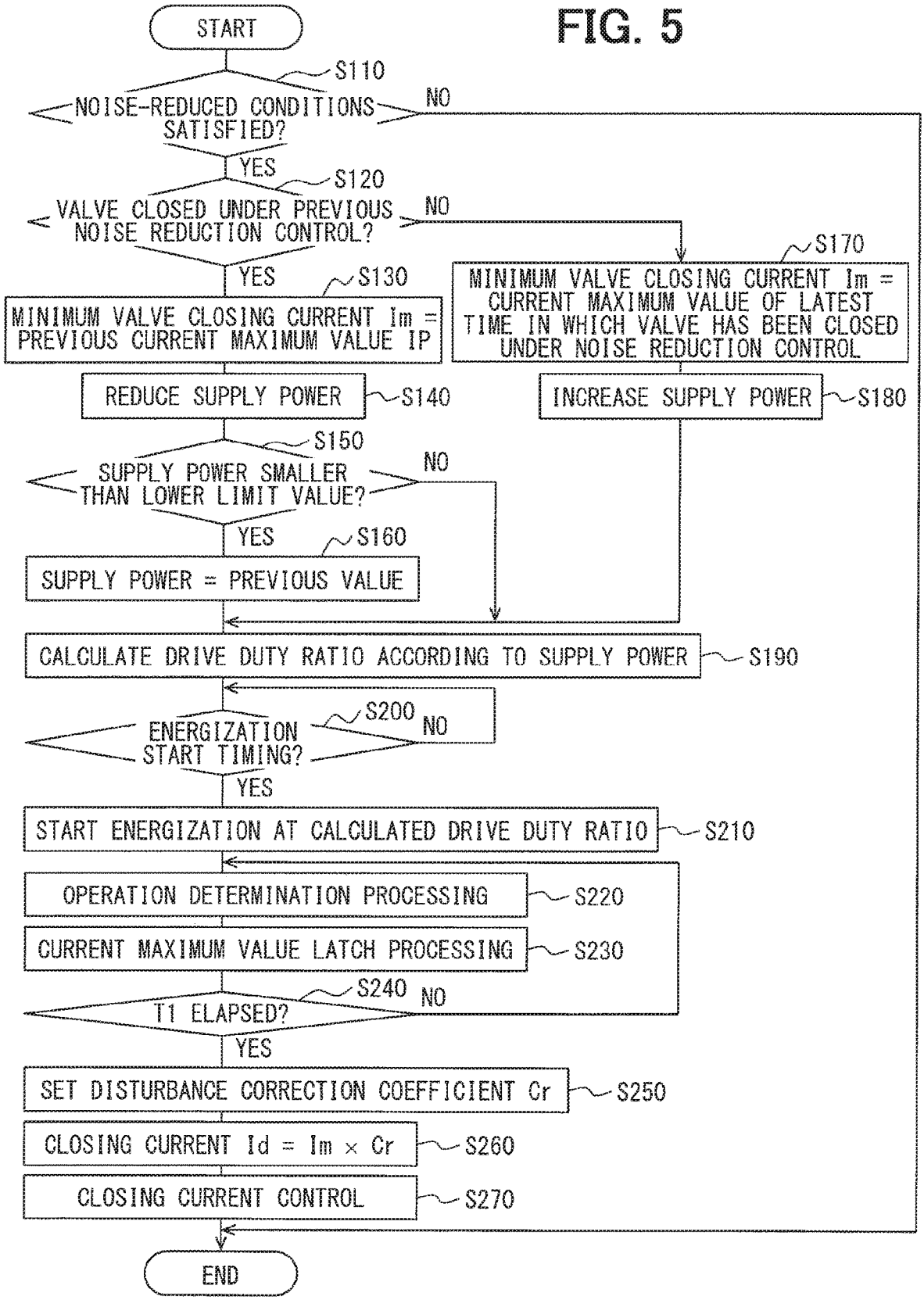
FIG. 5 is a flowchart illustrating control processing according to the first embodiment.

The microcomputer 51 starts the control processing in FIG. 5 every time a timing earlier than the energization start timing of the solenoid 35 in the plunger rising period by a predetermined time or a predetermined crank angle comes.

As illustrated in FIG. 5, when the microcomputer 51 starts the control processing, the microcomputer 51 determines whether the noise-reduced condition is satisfied, or not, in S110. In S116, if the microcomputer 51 determines that the noise-reduced condition is not satisfied, the microcomputer 51 completes the control processing. In that case, the microcomputer 51 performs the processing in the normal mode described above.

On the other hand, if the microcomputer 51 determines that the noise-reduced condition is satisfied in Step S110, the microcomputer 51 proceeds to S120. The processing after S120 in FIG. 5 is implemented in the noise reduction mode.

The microcomputer 51 determines whether the valve body 28 has been closed under the previous noise reduction control, or not, in S120. In more detail, the previous noise reduction control represents the noise reduction control implemented in the energization period during the previous plunger rising period. Incidentally, whether the valve body 28 has been closed under the noise reduction control, or not, is determined by the operation determination processing in S220 which will be described later. In the operation determination processing, if it is determined that the valve body 28 has been closed under the noise reduction control, an operation determination flag is set. For that reason, in S120, referring to the operation determination flag indicative of the determination result by the operation determination processing in the previous S220, it is determined whether the valve body 28 has been closed under the previous noise reduction control, or not.

If the positive determination is made in S120, that is, if it is determined that the valve body 28 has been closed under the previous noise reduction control, the microcomputer 51 proceeds to S130. In S130, the microcomputer 51 sets a previous current maximum value Ip as a minimum valve closing current Im. The current maximum value Ip is a maximum value (that is, a peak value) of the current flowing in the solenoid 35 under the noise reduction control. Hence, in that case, the previous current maximum value Ip represents the maximum value of the current flowing in the solenoid 35 under the previous noise reduction control. The minimum valve closing current Im represents a value estimating a minimum solenoid current that enables the valve body 28 to be closed.

The microcomputer 51 sets a power (hereinafter referred to as "supply power") to be supplied to the solenoid 35 under the noise reduction control to a value decreased from a previous value by a predetermined value Δm in subsequent S140. The microcomputer 51 determines whether the supply power set in S140 is less than a lower limit value, or not, in subsequent S150, and if the supply power is less than the lower limit value, the microcomputer 51 again sets the supply power to the previous value in S160, and thereafter proceeds to S190. If the microcomputer 51 determines that the supply power is not smaller than the lower limit value in S150, the microcomputer 51 proceeds to S190 as it is. The lower limit value used for determination in S150 represents a value that conceivably disables the valve body 28 to be closed under the noise reduction control in the supply power smaller than the lower limit value.

If the negative determination is made in S120, that is, if it is determined that the valve body 28 has not been closed under the previous noise reduction control, the microcomputer 51 proceeds to S170. In S170, the microcomputer 51 sets the current maximum value Ip of the latest time, in which the valve body 28 has been closed under the noise reduction control, as the minimum valve closing current Im. In more detail, the current maximum value Ip of the latest time, in which the valve body 28 has been closed under the noise reduction control, represents the maximum value of the current flowing in the solenoid 35 under the noise reduction control of the latest time in which the valve body 28 could be closed. In other words, the recent current maximum value Ip represents the maximum value of the current flowing in the solenoid 35 under the recent noise reduction control in which it is determined in the operation determination processing of S220 that the valve body 28 has been closed.

Then, the microcomputer 51 sets the supply power to a value increased from the previous value by a predetermined value Δp from the previous value in subsequent S180, and thereafter proceeds to S190. The microcomputer 51 calculates the drive duty ratio corresponding to the supply power as the drive duty ratio of the drive transistor 56 in S190. For example, a map indicative of a correspondence between the supply power and the drive duty ratio is stored in the ROM 53, and in S190, the drive duty ratio corresponding to the supply power is calculated from the map.

The drive duty ratio calculated in S190 is a value smaller than 100% of the normal time. When it is determined that the noise-reduced condition is satisfied in S110 first after the ECU 41 starts with the driver's operation of turning on an ignition, a process of setting an initial value for each of the supply power and the minimum valve closing current Im is performed instead of the processes of S120 to S180. In this case, in S190, the drive duty ratio corresponding to the supply power of the initial value is calculated.

In subsequent S200, the microcomputer 51 determines whether the energization start timing of the solenoid 35 has come, or not, and if it is determined that the energization start timing has come, the microcomputer 51 proceeds to S210.

In S210, the microcomputer 51 starts to energize the solenoid 35 at the drive duty ratio calculated in S190. In other words, the microcomputer 51 starts the noise reduction control. Specifically, the microcomputer 51 starts to output the drive signal having the drive duty ratio calculated in S190 to the pump drive circuit 50. Then, the drive transistor 56 is turned on and off at the drive duty ratio of the drive signal, and starts to energize the solenoid 35 under the noise reduction control. The microcomputer 51 resets the operation determination flag when starting the noise reduction control in S210.

After starting the noise reduction control in S210, the microcomputer 51 performs the operation determination processing in the subsequent S220, and performs current maximum value latch processing in the subsequent S230. The operation determination processing and the current maximum value latch processing will be described later. In S240, the microcomputer 51 determines whether the above-described first time T1 has elapsed since the energization start timing of the solenoid 35, or not, and if the microcomputer 51 determines that the above-described first time T1 has not elapsed, the microcomputer 51 returns to S220. Hence, the microcomputer 51 performs the operation determination processing in S220 and performs the current maximum value latch processing in S230 while the microcomputer 51 is implementing the noise reduction control.

Subsequently, the operation determination processing and the current maximum value latch processing will be described. When the movable portion 33 and the valve body 28 have moved with the energization of the solenoid 35, the motion appears as a change in the solenoid current. Specifically, when the movable portion 33 comes closer to the solenoid 35, an inductance of the solenoid 35 is increased with the result that the solenoid current is gradually reduced. For that reason, in a state where the noise reduction control is implemented, as illustrated in FIG. 4, the solenoid current is increased with time immediately after the energization starts. Thereafter, the solenoid current is gradually lowered as the movable portion 33 comes closer to the close side end position (that is, the stopper portion 38). When the movable portion 33 abuts against the stopper portion 38 and stops, the inductance of the solenoid 35 is again kept constant, and the solenoid current again rises.

In other words, when the movable portion 33 moves to the close side end position to close the valve body 28 with the energization of the solenoid 35 under the noise reduction control, the solenoid current is switched from an increasing tendency to a decreasing tendency, and thereafter changes from the decreasing tendency to rising. As a result, as illustrated in FIG. 4, a folding point P1 appears in the solenoid current.

On the other hand, when the movable portion 33 is not moved from the open side end position in the close acting direction even if the solenoid 35 is energized under the noise reduction control, that is, when the valve body 28 is not closed under the noise reduction control, the solenoid current is kept to have the increasing tendency.

For that reason, the microcomputer 51 determines whether the valve body 28 has been closed, or not, on the basis of a change in the solenoid current, or not, in the operation determination processing of S220. The operation, in which the valve body 28 is closed, corresponds to that the high-pressure pump 16 is operated. Specifically, in the operation determination processing of S220, the microcomputer 51 calculates a differential value (that is, speed) of the solenoid current, and determines whether the differential value becomes less than a negative determination value, or not. Then, if the microcomputer 51 determines that the differential value becomes less than the determination value, the microcomputer 51 determines that the valve body 28 has been closed, and sets an operation determination flag.

Meanwhile, the details of the above operation determination processing are disclosed in Patent Document 1. Whether the valve body 28 has been closed, or not, may be determined on the basis of a change in a voltage between both ends of the solenoid 35, for example, as disclosed in Patent Document 1.

In the current maximum value latch processing of S230, the microcomputer 51 monitors the solenoid current, and detects the maximum value of the solenoid current. For example, the microcomputer 51 calculates an absolute value of the differential value of the solenoid current, and determines whether the absolute value is equal to or less than a predetermined value closer to 0, or not, and if the microcomputer 51 determines that the absolute value is equal to or less than the predetermined value, the microcomputer 51 stores the solenoid current at that time as a maximum value.

If the microcomputer 51 determines that the valve body 28 has been closed in previous S220, the microcomputer 51 stores the maximum value stored at that time as a latest current maximum value Ip. The current maximum value Ip stored in this way is used in S130 or S170.

If the microcomputer 51 determines that the first time T1 has elapsed in S240, the microcomputer 51 proceeds to S250. The microcomputer 51 sets a disturbance correction coefficient Cr in S250. The disturbance correction coefficient Cr is used to calculate the closing current Id on the basis of the minimum valve closing current Im set in S130 or S170, and a minimum value of the disturbance correction coefficient Cr is more than 1. The microcomputer 51 sets the disturbance correction coefficient Cr to a larger value under a circumstance where the valve body 28 is more unlikely to be closed. For example, the microcomputer 51 sets the disturbance correction coefficient Cr to a larger value as the coolant temperature of the engine is lower. The coolant temperature may be replaced with, for example, a temperature of an engine oil (that is, oil temperature) or an outside air temperature. The disturbance correction coefficient Cr may be set to a fixed value more than 1. The minimum value of the disturbance correction coefficient Cr variably set may be set to 1.

The microcomputer 51 sets a value obtained by multiplying the minimum valve closing current Im by the disturbance correction coefficient Cr as the closing current Id in subsequent S260, and switches from the noise reduction control to the closing current control in subsequent S270. In other words, the microcomputer 51 starts the closing current control. In the closing current control, the microcomputer 51 regulates the drive duty ratio of the drive transistor 56 so that the solenoid current is maintained at the closing current Id set in S260.

Upon implementing the closing current control only for the second time T2, the microcomputer 51 completes the closing current control processing, and subsequently performs the holding current control described above. Thereafter, the microcomputer 51 performs the re-energization processing described above.

(Operation Example)

Figure 6:
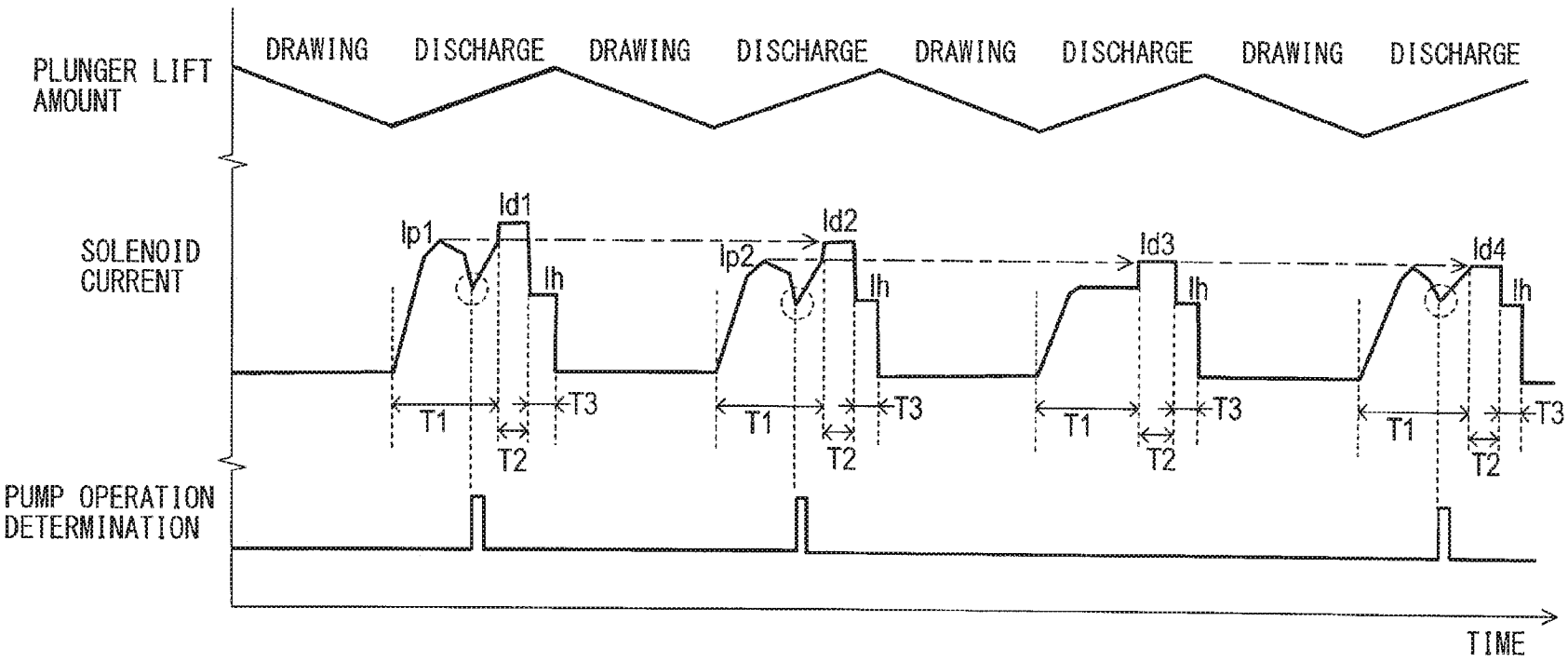
FIG. 6 is a time chart illustrating an action example according to the first embodiment.

An operation example of the control processing in FIG. 5 will be described with reference to FIG. 6. In an example of FIG. 6, the disturbance correction coefficient Cr is set to 1. In FIG. 6, the energization of the solenoid 35 in the plunger rising period is completed at the pump TDC timing. In FIG. 6, the re-energization for noise reduction is omitted from illustration. In a stage of "pump operation determination" in FIG. 6, high waveforms indicate that it is determined that the valve body 28 has been closed in the operation determination processing of S220. The same is applied to FIG. 8 which will be described later.

Referring to FIG. 6, in a first energization period on the most left side, the valve body 28 is closed under the noise reduction control, and the current maximum value Ip at that time is Ip1. In the first energization period, the closing current Id for the closing current control implemented after the noise reduction control is Id1.

In FIG. 6, in the noise reduction control in a second energization period, because the valve body 28 has been closed under the previous (that is, first) noise reduction control, the supply power to the solenoid 35 is reduced more than the previous value. Specifically, the drive duty ratio is set to a value smaller than the previous value. This is caused by the processing of S140 and S190.

A closing current Id2 for the closing current control implemented after the noise reduction control in the second energization period is a value obtained by multiplying the previous current maximum value Ip1 by the disturbance correction coefficient Cr. This is caused by the processing of S130 and S260.

Similarly, in the second energization period, the valve body 28 is closed under the noise reduction control, and the current maximum value Ip at that time is Ip2. For that reason, in FIG. 6, in the noise reduction control in a third energization period, the supply power of the solenoid 35 is reduced more than the previous value.

A closing current Id3 for the closing current control implemented after the noise reduction control in the third energization period is a value Id3 obtained by multiplying the previous current maximum value Ip2 by the disturbance correction coefficient Cr. In the third energization period, the valve body 28 is not closed under the noise reduction control, but the closing current Id3 flows in the solenoid 35 under the closing current control. Because the closing current Id3 is equal to or more than the current maximum value Ip2 under the previous noise reduction control in which the valve body 28 can be closed, the closing current Id3 is a current that can close the valve body 28. Hence, in the third energization period, even if the valve body 28 cannot be closed under the noise reduction control, the valve body 28 can be closed under the closing current control.

In FIG. 6, in the noise reduction control in a fourth energization period, because the valve body 28 has not been closed under the previous (that is, third) noise reduction control, the supply power to the solenoid 35 is increased more than the previous value. Specifically, the drive duty ratio is set to a value larger than the previous value. This is caused by the processing of S180 and S190. Then, in the fourth energization period, the valve body 28 is closed under the noise reduction control.

The closing current Id4 for the closing current control implemented after the noise reduction control in the fourth energization period is a value obtained by multiplying the current maximum value Ip2 in the second energization period. The second energization period is the latest time in which the valve body 28 has been closed under the noise reduction control by the disturbance correction coefficient Cr. This is caused by the processing of S170 and S260.

(Effects)

The first embodiment described in detail above obtains the following effects.

(1a) In the energization period of the solenoid 35, the noise reduction control is implemented only for the first time T1, and thereafter the closing current Id is supplied to the solenoid 35 under the closing current control. For that reason, the valve body 28 of the high-pressure pump 16 can be surely closed. Hence, the operating noise reduction of the high-pressure pump 16 under the noise reduction control and the reliable operation of the high-pressure pump 16 can be achieved.

(1b) In the control processing of FIG. 5, the microcomputer 51 determines the closing current Id for the closing current control on the basis of the previous determination result of the operation determination processing through the processing of S120, S130, S170, S230, S250, and S260. For that reason, the closing current Id that enables the valve body 28 to be closed can be set to a just enough appropriate value.

As a modification, in S130 and S170, fixed values different from each other may be set as the minimum valve closing current Im. For example, if a positive determination is made in S120 of FIG. 5, because the supply power under the present noise reduction control is reduced in S140, the minimum valve closing current Im for determining the closing current Id may be set to a value larger than the value set in S170, in S130.

1c) In the control processing of FIG. 5, if the positive determination is made in S120, that is, if the positive determination in which the valve body 28 has been closed is made in the previous operation determination processing, the microcomputer 51 determines the closing current Id on the basis of the previous current maximum value Ip. The above control is produced by the processing of S130 and S260. If a negative determination is made in S120, that is, if the negative determination in which the valve body 28 has not been closed is made in the previous operation determination processing, the microcomputer 51 determines the closing current Id on the basis of the current maximum value Ip of the latest time in which the valve body 28 has been closed under the noise reduction control. The above control is produced by the processing of S170 and S260.

For that reason, the closing current Id that enables the valve body 28 to be closed can be set to a more appropriate value. Specifically, the closing current Id can be restricted from becoming extremely large or small Hence, the power for energizing the solenoid 35 can be reduced while achieving the reliable closing of the valve body 28. That the positive determination is made in the previous operation determination processing corresponds to a case in which the previous determination result of the operation determination processing is a positive determination result that "the valve body 28 has been put into the closed state". That the negative determination is made in the previous operation determination processing corresponds to a case in which the previous determination result of the operation determination processing is a negative determination result that "the valve body 28 has not been put into the closed state".

(1d) In the control processing of FIG. 5, even if the microcomputer 51 performs any processing of S130 and S170, the microcomputer 51 eventually sets the current maximum value Ip of the latest time in which the valve body 28 has been closed in the noise reduction control as the minimum valve closing current Im. The microcomputer 51 determines a value obtained by multiplying the minimum valve closing current Im by the disturbance correction coefficient Cr larger than 1 as the closing current Id through the processing of S260. For that reason, the microcomputer 51 can set the closing current Id to a current value that enables the valve body 28 to be surely closed. For example, the solenoid current that enables the valve body 28 to be closed is likely to be changed between the present plunger rising period and the previous plunger rising period due to a difference in the environment such as a temperature. However, the control processing of FIG. 5 can cope with such a change. In addition, the disturbance correction coefficient Cr is variably set on the basis of the environmental information such as the coolant temperature of the engine, the oil temperature, and/or the outside air temperature, thereby being capable of providing a more appropriate value of the closing current Id.

(1e) In the control processing of FIG. 5, the microcomputer 51 controls an increase or decrease of the supply power under the noise reduction control on the basis of the previous determination result of the operation determination processing through the processing of S120, S140, and S180. For that reason, the microcomputer 51 can provide an appropriate supply power under the noise reduction control. Even when the supply power is reduced under the increase/decrease control, and the valve body 28 cannot be closed under the noise reduction control, the valve body 28 can be closed under the closing current control of that time.

In the first embodiment, the spring 31 may correspond to the first spring, and the spring 34 may correspond to the second spring. The microcomputer 51 may function as the reduction control unit, the closing control unit, the operation determination unit, and the determination unit. The steps of the control processing in FIG. 5, S120, S140 to S160, S180 to S210, and S240 may correspond to the processing as the reduction control unit, and S270 may correspond to the processing as the closing control unit. S220 may correspond to the processing as the operation determination unit, and S120, S130, S170, S230, S250, and S260 may correspond to the processing as the determination unit.

Second Embodiment (Differences from First Embodiment)

A second embodiment is identical in a basic configuration with the first embodiment, and therefore common configurations will be omitted from a description, and differences will be mainly described. Incidentally, the same reference numerals as those in the first embodiment denote identical configurations, and a preceding description is referred to.

A fuel supply system 1 according to the second embodiment is different from the first embodiment in that a microcomputer 51 performs control processing of FIG. 7 instead of the control processing in FIG. 5. The control processing in FIG. 7 is different from the control processing in FIG. 5 in the following processing (D1) and (D2).

(D1) S130 and S170 are deleted.

(D2) S250 to S270 are replaced with S310 to S350.

As illustrated in FIG. 7, if the microcomputer 51 determines in S240 that the first time T1 has elapsed, the microcomputer 51 proceeds S310, and determines whether the valve body 28 has been closed under the present noise reduction control, or not, referring to the above-mentioned operation determination flag.

If the microcomputer 51 determines in S310 that the valve body 28 has been closed under the present noise reduction control, the microcomputer 51 proceeds to S320, and sets the present current maximum value Ip as the minimum valve closing current Im. The present current maximum value Ip represents the maximum value of the current flowing in the solenoid 35 under the present noise reduction control in which the valve body 28 could be closed.

After performing the processing in S320, the microcomputer 51 completes the control processing in FIG. 7 without performing the closing current control, and switches from the noise reduction control to the above-mentioned holding current control. The holding current control is implemented until the energization period of the solenoid 35 is completed. Thereafter, the microcomputer 51 performs the processing of the re-energization described above.

If the microcomputer 51 determines in S310 that the valve body 28 has not been closed under the present noise reduction control, the microcomputer 51 proceeds to S330. The microcomputer 51 sets the disturbance correction coefficient Cr in S330 as with S250 of FIG. 5, and sets a value obtained by multiplying the minimum valve closing current Im by the disturbance correction coefficient Cr as the closing current Id in subsequent S340 like S260 of FIG. 5.

The microcomputer 51 switches from the noise reduction control to the closing current control in subsequent S350. In other words, the microcomputer 51 starts the closing current control. Under the closing current control, the microcomputer 51 regulates the drive duty ratio of the drive transistor 56 so that the solenoid current is kept at the closing current Id set in S340.

Upon implementing the closing current control only for the second time T2, the microcomputer 51 completes the control processing of FIG. 7, and subsequently performs the holding current control described above until the energization period of the solenoid 35 is completed. Thereafter, the microcomputer 51 performs the processing of the re-energization described above.

In other words, in the second embodiment, the microcomputer 51 implements the closing current control if the microcomputer 51 makes the negative determination that the valve body 28 has not been closed under the operation determination processing. However, the microcomputer 51 ceases the closing current control if the microcomputer 51 makes the positive determination that the valve body 28 has been closed under the operation determination processing.

(Operation Example)

Figure 8:
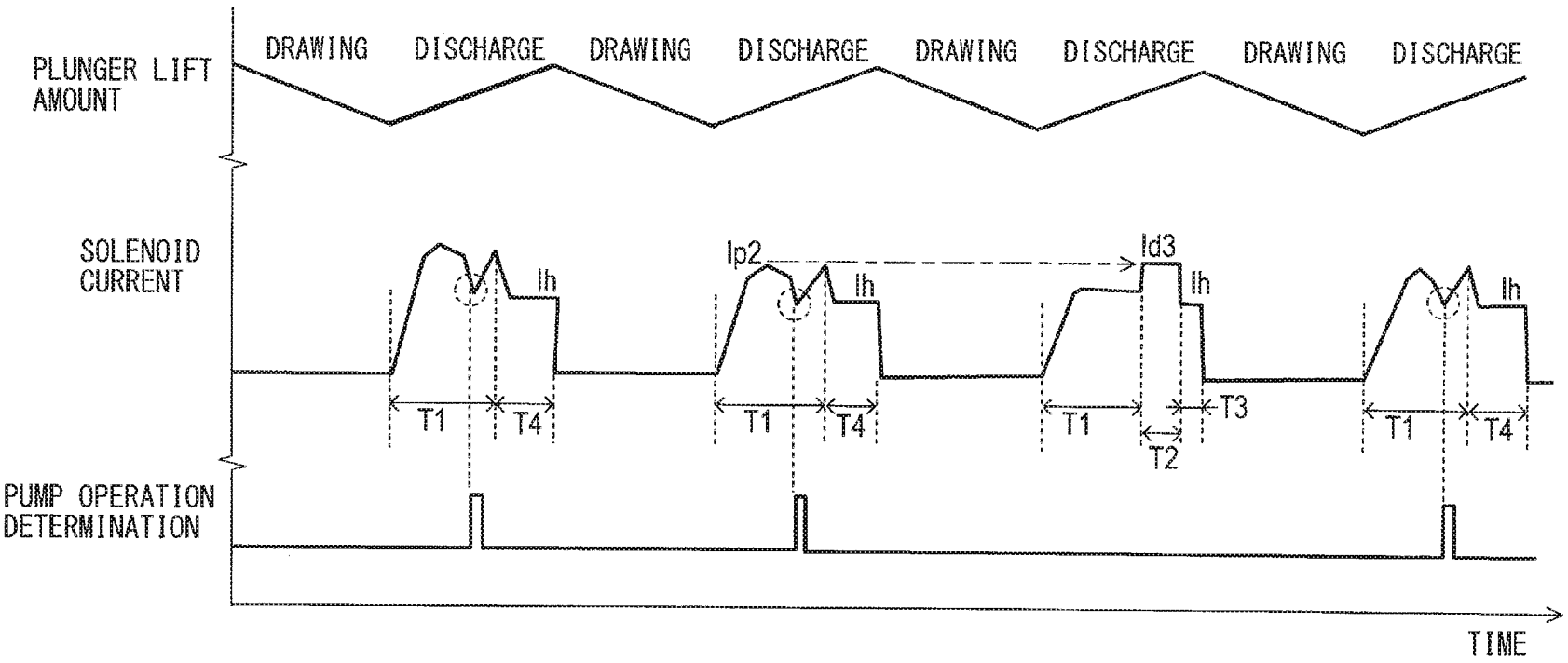
FIG. 8 is a time chart illustrating an action example according to the second embodiment.

An operation example of the control processing in FIG. 7 will be described with reference to FIG. 8. Referring to FIG. 8, in a first energization period on the most left side, because the valve body 28 has been closed under the noise reduction control, the closing current control is not implemented. For that reason, the noise reduction control is implemented since the energization period starts until the first time T1 elapses, and the holding current control is implemented in a period of a time T4 since the first time T1 has elapsed until the energization period is completed.

Referring to FIG. 8, in the second energization period, because the valve body 28 has been closed under the previous (that is, first) noise reduction control, the supply power to the solenoid 35 under the noise reduction control is reduced more than the previous value. This is caused by the processing of S140 and S190.

Similarly, in the second energization period, because the valve body 28 has been closed under the noise reduction control, the closing current control is not implemented. The current maximum value Ip of this time is denoted by Ip2. Referring to FIG. 8, even in the third energization period, because the valve body 28 has been closed under the previous (that is, second) noise reduction control, the supply power to the solenoid 35 under the noise reduction control is reduced more than the previous value.

In the third energization period, because the valve body 28 is not closed under the noise reduction control, the closing current Id3 flows in the solenoid 35 under the closing current control. The closing current Id3 is a value obtained by multiplying the current maximum value Ip2 under the second noise reduction control that is the latest time in which the valve body 28 could be closed by the disturbance correction coefficient Cr. This is caused by the processing of S320 and S340. For that reason, in the third energization period, even if the valve body 28 is not closed under the noise reduction control, the valve body 28 is closed under the closing current control.

In FIG. 8, in the noise reduction control in a fourth energization period, because the valve body 28 has not been closed under the previous (that is, third) noise reduction control, the supply power to the solenoid 35 is increased more than the previous value. This is caused by the processing of S180 and S190. Similarly, in the fourth energization period, because the valve body 28 has been closed under the noise reduction control, the closing current control is not implemented.

(Effects)

According to the second embodiment, the following effects can be obtained in addition to the effects (1a) and (1e) of the first embodiment described above.

(2a) In the energization period of the time in which the valve body 28 has been closed under the noise reduction control, because the closing current control is not executed, the power for energizing the solenoid 35 can be reduced.

(2b) In the control processing of FIG. 7, if the microcomputer 51 determines that the valve body 28 has not been closed under the present noise reduction control, the microcomputer 51 determines the closing current Id on the basis of the current maximum value Ip of the latest time in which the valve body 28 has been closed under the noise reduction control. This is produced by the processing of S230 and S310 to S340.

For that reason, the closing current Id that enables the valve body 28 to be closed can be set to a just enough appropriate value. Hence, the power for energizing the solenoid 35 can be reduced while realizing the reliable closing of the valve body 28.

(2c) In the control processing of FIG. 7, the microcomputer 51 sets the current maximum value Ip of the latest time in which the valve body 28 has been closed under the noise reduction control as the minimum valve closing current Im.

The microcomputer 51 determines a value obtained by multiplying the minimum valve closing current Im by the disturbance correction coefficient Cr larger than 1 as the closing current Id through the processing of S340. For that reason, the microcomputer 51 can set the closing current Id to a current value that enables the valve body 28 to be surely closed. The control processing of FIG. 7 can cope with the change exemplified in the description of the effect (1d) of the first embodiment.

Meanwhile, in the second embodiment, the microcomputer 51 functions as the reduction control unit, the closing control unit, the operation determination unit, and the current determination unit. In the steps of the control processing in FIG. 7, S120, S140 to S160, S180 to S210, and S240 correspond to the processing as the reduction control unit, and S350 corresponds to the processing as the closing control unit. S220 corresponds to the processing as the operation determination unit, and S230 and S310 to S340 correspond to the processing as the current determination unit.

Other Embodiments

The embodiments for carrying out the present disclosure have been described above. However, the present disclosure is not limited to the above-mentioned embodiments, but can be variously modified.

For example, the supply power under the noise reduction control is not increased or decreased depending on whether the valve body 28 has been closed under the previous noise reduction control, or not, but may be fixed. Specifically, the drive duty ratio under the noise reduction control may be set to a fixed value.

The multiple functions provided in one component in the above embodiments may be produced by multiple components, or one function provided in one component may be produced by the multiple components. The multiple functions provided in the multiple components may be produced by one component, or one function produced by the multiple components may be produced by one component. A part of the configuration of the above-described embodiments may be omitted. Also, at least a part of the configuration in the above embodiments may be added to or replaced with another configuration in the above embodiments. Meanwhile, all aspects that are included in the technical spirit that is specified in the attached claims are embodiments of the present disclosure. Also, the present disclosure can be produced by various configurations such as a system having the ECU 41 as a component, a program for causing a computer to function as the ECU 41, a non-transitory tangible recording medium storing the program therein such as a semiconductor memory or the like, or a method for controlling the high-pressure pump in addition to the above-mentioned ECU 41.

The high-pressure pump controlled by the high-pressure pump control unit described above includes a pressurizing chamber 21 having an inlet port 25 and a discharge port 26 of the fuel, and a plunger 22 that moves back and forth in the pressurizing chamber. Further, the high-pressure pump includes a valve body 28 that opens and closes a fuel passage 27 that is led to the intake port, a first spring 31 that urges the valve body in a closing direction which is a direction of putting the valve body in a closed state to close the fuel passage of the movement directions of the value body, and an electromagnetic actuator 32 that causes the opening and closing movement of the valve body. The electromagnetic actuator includes a movable portion 33 that is urged by a second spring 34 to press the valve body in an opening direction opposite to the closing direction, and a solenoid 35 that is energized to attract the movable portion in a close acting direction opposite to the direction of causing the movable portion to press the valve body to put the valve body into the closed state. In the high-pressure pump, in a plunger rising period when the plunger rises from a bottom dead center to a top dead center, the valve body is put into the closed state with the energization of the solenoid, and the fuel in the pressurizing chamber is discharged from the discharge port.

The high-pressure pump control unit according to the present disclosure includes the reduction control units S120, S140 to S160, S180 to S210, and S240, and the closing control unit S270 and S350 as the control units that operate when a condition in which the noise generated in the high-pressure pump, that is, the operating noise is reduced is satisfied.

During the plunger rising period, the reduction control unit implements the noise reduction control that is a control for slowing down the moving speed in the close acting direction of the movable portion by supplying the power smaller than that when the condition is not satisfied to the solenoid until a predetermined time elapses since the energization start timing of the solenoid. The predetermined time is a time shorter than the energization period in which the current flows in the solenoid. The closing control unit causes the closing current that is a constant current for surely putting the valve body into the closed state to flow in the solenoid upon the completion of the noise reduction control, in the plunger rising period.

In the high-pressure pump control unit described above, in the period in which the current flows in the solenoid, the noise reduction control is implemented only for the predetermined time, and upon the completion of the noise reduction control, the constant closing current is supplied to the solenoid. Therefore, the valve body of the high-pressure pump can be surely put into the closed state. Hence, the operating noise reduction of the high-pressure pump and the reliable operation can be achieved.

Symbols in parenthesis described in the columns and the claims represent a correspondence relationship with specific means described in embodiments described above as one aspect, but do not restrict the technical scope of the present disclosure.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A high-pressure pump control unit configured to control a high-pressure pump, the high-pressure pump including:

a pressurizing chamber having an intake port and a discharge port of fuel;

a plunger configured to move back and forth in the pressurizing chamber;

a valve body configured to open and close a fuel passage that is led to the intake port;

a first spring configured to urge the valve body in a closing direction to put the valve body into a closed state in which the valve body closes the fuel passage; and an electromagnetic actuator configured to cause an opening and closing movement of the valve body, wherein the electromagnetic actuator includes a movable portion, which is urged by a second spring to bias the valve body in an opening direction opposite to the closing direction, and a solenoid, which is energized to draw the movable portion in a close acting direction, which is opposite to the direction in which the movable portion pushes the valve body, to put the valve body into the closed state, and in a plunger rising period, in which the plunger rises from a bottom dead center to a top dead center, the solenoid is configured to be energized to put the valve body into the closed state and to discharge fuel in the pressurizing chamber from the discharge port, the high-pressure pump control unit comprising:

a reduction control unit configured, when a condition for reducing a noise caused in the high-pressure pump is satisfied, to implement a noise reduction control to supply a second power smaller than a first power, which is supplied when the condition is not satisfied, to reduce a moving speed of the movable portion in the close acting direction for a predetermined time after an energization start timing of the solenoid in the plunger rising period, the predetermined time is shorter than an energization period in which a current flows in the solenoid; and a closing control unit configured, when the condition is satisfied, to cause a closing current, which is a constant current to cause an electric power greater than the first electric power for surely putting the valve body into the closed state, to flow the closing current in the solenoid when the noise reduction control is completed in the plunger rising period, and cause a holding current to flow in the solenoid after causing the closing current in the plunger rising period, the holding current is greater than zero and is less than the closing current;

an operation determination unit configured to determine whether the valve body is put into the closed state during a period in which the reduction control unit implements the noise reduction control; and a determination unit configured to determine the closing current, which is caused to flow in the solenoid by the closing control unit, based on a previous determination result of the operation determination unit, wherein the determination unit is configured to determine the closing current to be a maximum value of the current flowing in the solenoid under a previous noise reduction control, when the previous determination result of the operation determination unit is a positive determination result that the previous noise reduction control put the valve body into the closed state, and determine the closing current to be a maximum value of the current under a recent noise reduction control that is positively determined by the operation determination unit, when the previous determination result of the operation determination unit is a negative determination result that the previous noise reduction control did not put the valve body into the closed state.

2. The high-pressure pump control unit according to claim 1, wherein the determination unit is configured to determine the closing current by multiplying the maximum value by a coefficient larger than 1.

3. The high-pressure pump control unit according to claim 1, wherein the reduction control unit is configured to control an electric power to be supplied to the solenoid based on the previous determination result of the operation determination unit.

4. The high-pressure pump control unit according to claim 1, further comprising:

an operation determination unit configured to determine whether the valve body is put into the closed state during a period in which the reduction control unit implements the noise reduction control, wherein the closing control unit is configured to cause the closing current to flow in the solenoid when the operation determination unit makes a negative determination and to stop the closing current from flowing in the solenoid when the operation determination unit makes a positive determination.

5. The high-pressure pump control unit according to claim 4, further comprising:

a current determination unit configured, when the operation determination unit makes the negative determination, to determine the closing current, which is caused to flow in the solenoid by the closing control unit, based on the maximum value of the current flowing in the solenoid under the recent noise reduction control in which the positive determination is made by the operation determination unit.

6. The high-pressure pump control unit according to claim 5, wherein the current determination unit is configured to determine the closing current by multiplying a maximum value by a coefficient larger than 1.

7. The high-pressure pump control unit according to claim 4, wherein the reduction control unit is configured to control an electric power to be supplied to the solenoid based on the previous determination result of the operation determination unit.

8. The high-pressure pump control unit according to claim 1, wherein the holding current is a constant current.

9. The high-pressure pump control unit according to claim 8, wherein the closing control unit is configured to cause the holding current for a holding time period and thereafter to terminate the supply of electric power.

10. The high-pressure pump control unit according to claim 9, wherein the holding current when the condition is satisfied is the same in quantity as the holding current when the condition is not satisfied.

11. The high-pressure pump control unit according to claim 1, wherein the closing control unit is configured to increase the current supplied to the solenoid from the second electric power to the closing current, apply the closing current for a predetermined closing time, and to switch directly from the closing current to the holding current after the predetermined closing time.

12. The high-pressure pump control unit according to claim 1, wherein at least one of the reduction control unit and the closing control unit reuses a previous value for the second power or the closing current, respectively.

13. A high-pressure pump control system, comprising:

an electronic control unit (ECU) configured to control a high-pressure pump, the ECU includes a microcomputer, memory, and control circuitry, the ECU is configured to supply a first power to the high-pressure pump to drive an actuator at a moving speed in a close acting direction to strike a valve body of the high-pressure pump, implement a noise reduction control to supply a second power smaller than the first power to reduce the moving speed of the actuator in the close acting direction during a plunger rising period in which a plunger of the high-pressure pump rises from a bottom dead center to a top dead center;

apply a closing current to the actuator when the noise reduction control is completed during the plunger rising period, the closing current is a constant current to cause an electric power greater than the first electric power to ensure the valve body is put into a closed state in which the valve body closes a fuel passage of the high-pressure pump, and apply a holding current to flow in the solenoid after applying the closing current during the plunger rising period, the holding current is greater than zero and is less than the closing current;

determine whether the valve body is put into the closed state during the noise reduction control; and determine the closing current based on a previous determination result, set the closing current to be a peak value of the current flowing in the solenoid under an immediately preceding noise reduction control in response to determining a positive determination result that the immediately preceding noise reduction control put the valve body into the closed state, and set the closing current to be a peak value of the current under a recent noise reduction control, which occurred before the immediately preceding noise reduction control in response to determining a negative determination result that the previous noise reduction control did not put the valve body into the closed, the recent noise reduction control is determined as a positive determination result that the previous noise reduction control put the valve body into the closed state.

* * * * *